United States Patent [19]

Chandler et al.

[11] Patent Number: 5,074,803

[45] Date of Patent: Dec. 24, 1991

[54] LATCHING MECHANISM FOR SHIELDED DATA CONNECTOR

[75] Inventors: Curtis S. Chandler, King; Terry L. Pitts, Greensboro, both of N.C.

[73] Assignee: AMP Incorporated, Harrisburg, Pa.

[21] Appl. No.: 709,067

[22] Filed: May 30, 1991

Related U.S. Application Data

[63] Continuation of Ser. No. 590,636, Sep. 28, 1990, abandoned.

[51] Int. Cl.[5] ..... H01R 13/627

[52] U.S. Cl. ..... 439/347; 439/352; 439/372

[58] Field of Search ..... 439/350, 351, 352, 353, 439/354, 347, 372, 312

[56] References Cited

U.S. PATENT DOCUMENTS

| | | | |
|---|---|---|---|
| 3,885,851 | 5/1975 | Bennett | 439/352 |
| 4,332,432 | 6/1982 | Colleran | 439/347 |
| 4,619,494 | 10/1986 | Noorily et al. | 439/607 X |
| 4,711,511 | 12/1987 | Noorily | 439/347 |
| 4,718,857 | 1/1988 | Noschese | 439/351 X |
| 4,810,210 | 3/1989 | Komatsu | 439/610 |
| 4,838,808 | 6/1989 | Fujiura | 439/352 X |
| 4,884,981 | 12/1989 | Chandler | 439/610 |
| 4,946,404 | 8/1990 | Takenouchi et al. | 439/357 X |

FOREIGN PATENT DOCUMENTS 0026703 9/1980 France .

*Primary Examiner*—Larry I. Schwartz
*Assistant Examiner*—Julie R. Daulton

[57] ABSTRACT

A data connector is disclosed herein having a premolded one-piece insulative boot housing which is slidably receivable over a shielded subassembly to form a shielded data connector. The one-piece premolded boot housing includes integral latching arms pivotal relative to the housing portion via molded web hinges. The ends of the latching arms adacent the mating face of the connector include hermaphroditic latching members which are capable of latching to an identical electrical connector. A locking ring is receivable over the rearward side of the premolded boot housing and is movable between a locked and unlocked position. When in the locked position, transverse channels formed in the locking ring encompass free ends of the latching arms thereby preventing pivotal movement of the latching arms.

12 Claims, 5 Drawing Sheets

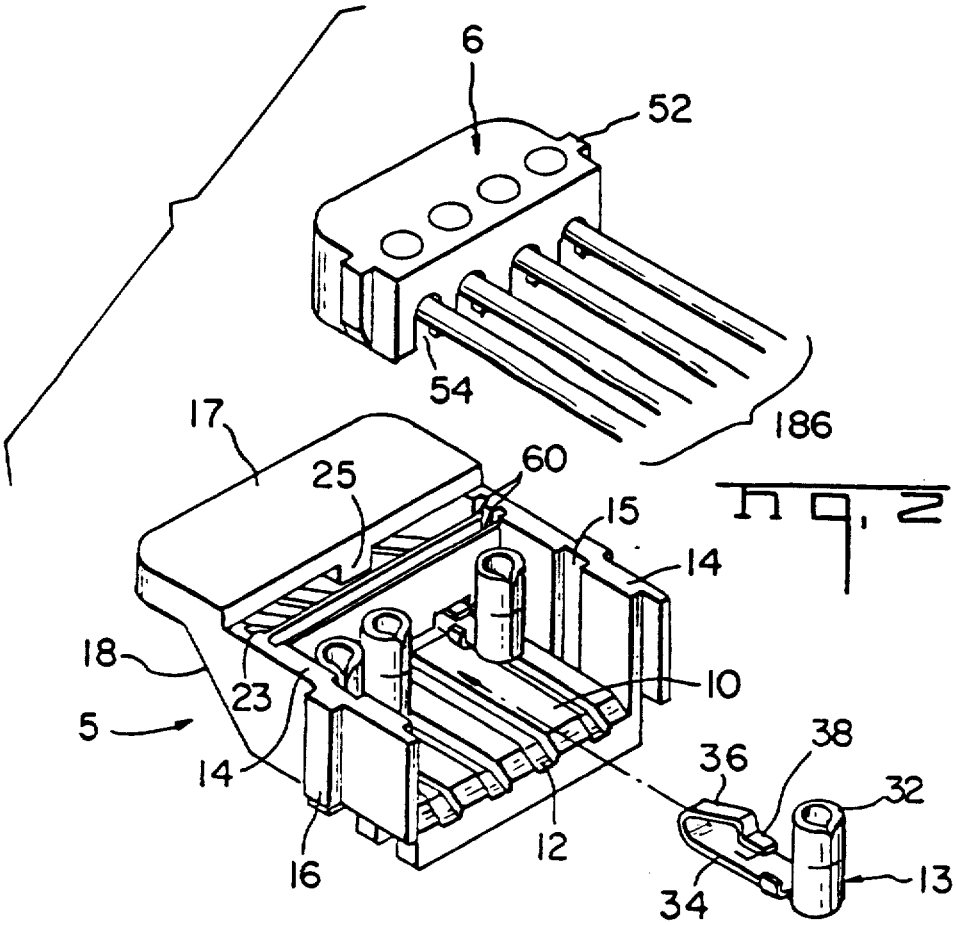
Fig. 2
Fig. 3
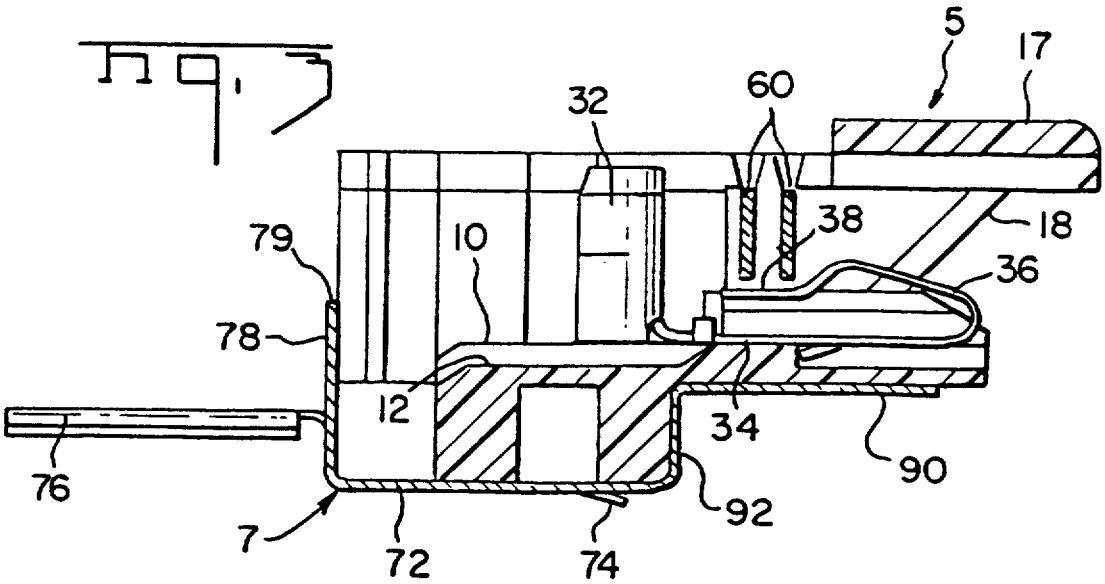

LATCHING MECHANISM FOR SHIELDED DATA CONNECTOR

This application is a continuation of application Ser. No. 07/590,636 filed Sept. 28, 1990, now abandoned.

BACKGROUND OF THE INVENTION

1. Field of the Invention

The invention relates to electrical connectors for use in terminating shielded multiconductor cables and more specifically to a data connector having a slidable retention member for locking the data connector in a latched configuration.

2. Description of the Prior Art

U.S. Pat. No. RE 32,760, incorporated herein by reference, discloses a local area network connector specifically intended for use in the data communications industry. These connectors can be employed in a closed loop data communications link in which various equipment, such as computer terminals, can be interconnected in a system. These connectors are specifically adapted for use in interconnecting numerous micro- or mini-computers in a computer network in an office environment. Connectors of this type have standard interface dimensions and configurations.

U.S. Pat. No. 4,884,981, incorporated herein by reference, addresses a need within the local area network market for a lower cost and more versatile electrical connector which is suitable for use in a local area network in combination with prior art connectors of the type described herein. In particular, the electrical connector shown in U.S. Pat. No. 4,884,981, includes a shielded subassembly positioned within a one piece molded housing, where the one piece housing has a common interface structure as the prior art connectors.

There also exists within the industry, a need for retaining the electrical connector of U.S. Pat. No. 4,884,981 in a latched configuration with other electrical connectors when connected. In particular, the connectors need to be held in a latched configuration with electrical connectors mounted in a patch panel, so-called panel mount connectors, where a plurality of electrical connectors are positioned in a common panel for cross connect between various locations.

In the connector assembly shown in U.S. Pat. No. RE 32,760, a discrete locking member is available which is movable laterally between the latching arms and the top of the housing, filling the void between the latching arms and the housing on both sides of the integral web forming the hinge, thereby preventing the pivotal movement of the latching arms while the locking member is in place.

Another embodiment of locking mechanism is shown in U.S. Pat. No. 4,711,511 wherein each latching arm includes a locking bar between the pivotal arm and the housing and is longitudinally movable to perform a wedgelike function thereby preventing the pivotal movement of the latching arms when the locking bars are in the fully forward position.

It is an object of the invention to provide an improved shielded data connector having a latching mechanism which can be locked in a latched configuration.

Other objects and advantages of the invention will be apparent from the following description, the accompanying drawings and the appended claims.

SUMMARY OF THE INVENTION

The objects of the invention are accomplished by providing an electrical connector comprising an insulative housing having a mating face and a wire connecting face. Latching members are provided which are integrally connected to the opposite side surfaces of the housing, the latching members being integrally connected via molded webs of material medially positioned between ends of the latching members where one end of each latching member has a latching mechanism thereon for mating with a complementary electrical connector while opposite ends of the latching members are free to move upwardly and downwardly during the pivoting of the latching members. A locking ring peripherally surrounds the insulative housing and is movable longitudinally relative thereto between a locked and unlocked position. The locking ring has integral elongate channels adapted to encompass the free ends of the latching member when the locking ring is in the locked position thereby preventing the pivotal movement of the latching members, and the locking ring is movable to an unlocked position with the free ends of the latching members spaced from the channels and free to rotate about the webs.

By providing a locking ring which includes channels to encompass the free ends of the latching members, the locking ring, when in the locked position, prevents the pivotal movement of the latching mechanisms.

BRIEF DESCRIPTION OF THE DRAWINGS

FIG. 2 is an isometric view of the housing subassembly;

FIG. 3 is a cross-sectional view of the insulative housing with the lower shield in place;

DETAILED DESCRIPTION OF THE PREFERRED EMBODIMENT

Figure 1:
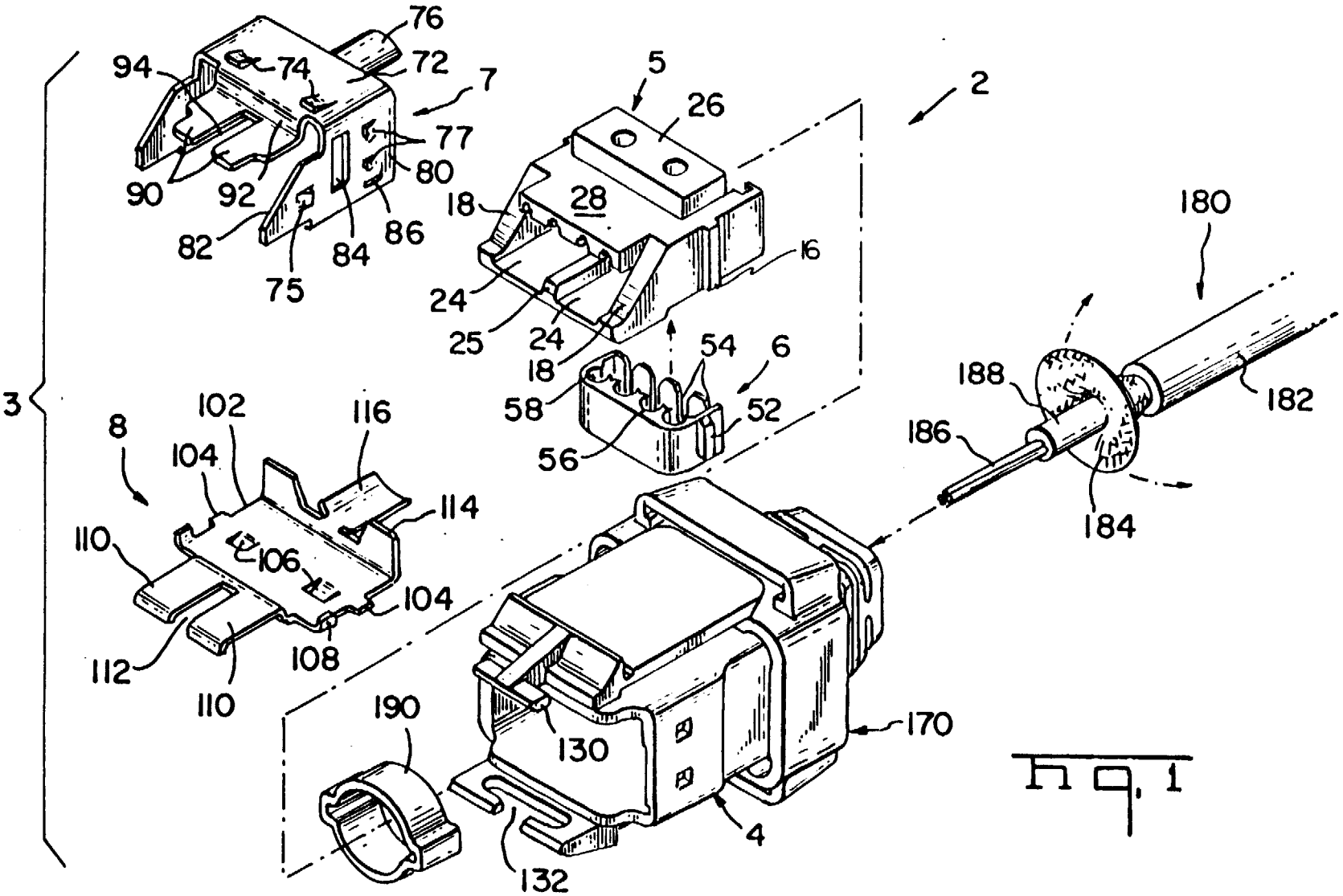
FIG. 1 is an isometric view of the shielded data connector of the present invention showing the various components exploded away from each other.

Referring first to FIG. 1, the data connector is generally shown at 2 comprising a shielded subassembly 3 and a premolded boot housing 4, the shielded subassembly 3 being slidably receivable into and out of the premolded boot housing 4 and being latchably attached therein. The shielded subassembly 3 and the premolded boot housing 4 are of the type generally shown in U.S. Pat. No. 4,884,981. The shielded subassembly 3 generally includes a housing member 5, a stuffer cap 6, and shield members 7 and 8. With reference now to FIGS. 1-3, the data connector housing 5 will be described in greater detail.

With reference first to FIG. 2, the housing 5 generally comprises a terminal support floor 10 having a plurality of channels 12 therein for receiving terminals 13. Extending from the terminal support floor 10 are side walls 14 having internal grooves 15 and external ribs 16. A portion 17 extends across the two side walls and together with the front edges 18 define a front mating face for the housing member 5.

Terminals 13 include insulation displacement wire barrels 32, a blade portion 34, a resilient contact portion 36 and a commoning foot 38. The resilient contact portion 36 is reversely bent upon itself and spaced above the terminal support floor 10. The resilient contact portion 36 is disposed at the front mating face of the housing 5 for overlapping interconnection with like terminals, the two resilient contact portions of mating connectors contacting each other to deflect respective resilient contact portions towards the blade portion of the respective terminals. Stuffer cap 6 includes alignment ribs 52 along the sides, wire receiving slots 54 and a lower surface 56 having stuffer cylinders 58 therein, where the stuffer cylinders have an inside diameter larger than the outside diameter of the barrels 32 of the terminals 13, as seen best in FIG. 1.

With reference still to FIG. 1, the shield member 7 includes a plate member 72 with continuous shield members 90 extending from the plate member 72 through a stepped portion 92, the two shield members 90 defining a slot 94 therebetween. The plate member 72 further includes two locking lances 77 for locking the shielded subassembly within the boot housing 4. The shield member 7 is shown in FIG. 3 as including a semicircular shielding tail 76 extending from a rear wall 78. With reference again to FIG. 1, the shield member 7 includes integral side walls 80 having windows 84 stamped therefrom (only one window is visible in FIG. 1). The forward edges of the side walls are defined by two 45° surfaces 82.

Shield member 8 is shown as including a plate member 102 with integral shielding portions 110 extending from the front edge thereof, the two shield members 110 defining a slot 112 therebetween. The shield member 8 further includes a rear wall portion 114 having a semicircular shield tail 116 extending from the rear wall 114. Plate member 102 further comprises locking lances 106 and tabs 104 and 108 extending from the side edges thereof.

Figure 9:
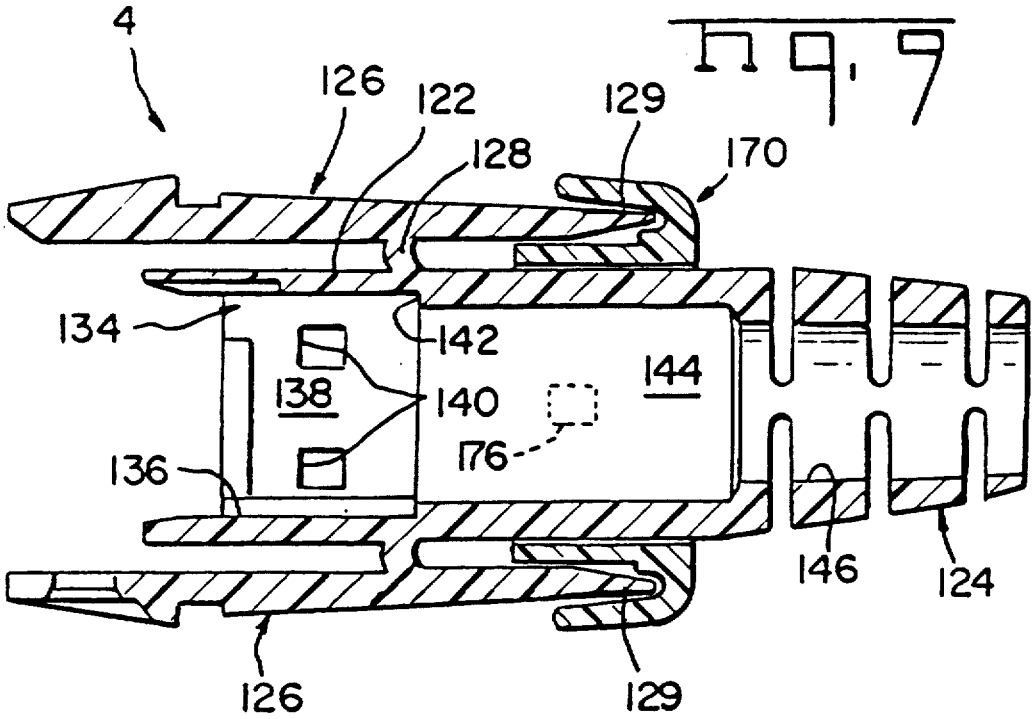
FIG. 9 is a view similar to that of FIG. 8 showing the slide retention member in its forwardmost position.

With reference now to FIG. 9, the premolded boot housing 4 includes a central body portion 122, a flexible wire receiving portion 124 and two latch members 126. The two latch members 126 are integrally molded to the central body portion 122 and are pivotal relative to the central body portion about integral hinges shown at 128. As shown in FIG. 1, the latching members 126 are hermaphroditic, where the front edge of one of the latch members includes a T-bar 130, whereas the other latch member includes a C-slot 132. It should be understood that two of the housing premolded boots are interconnectable when one of the connector boots is rotated about an axial centerline 180° relative to the other of the housing boots 4, such that a T-bar 130 mates with a C-slot 132 on a mating connector and the C-slot 132 mates with a T-bar 130 on the mating connector. To latch the two connectors into position, the latch members 126 on one of the connectors are moved so as to move the T-bar and C-slot towards each other while the latch members on the mating connector are moved away from each other. Movement of the two housings towards each other places the respective T-bars and C-slots in overlapping latching relation one to the other.

Figure 4:
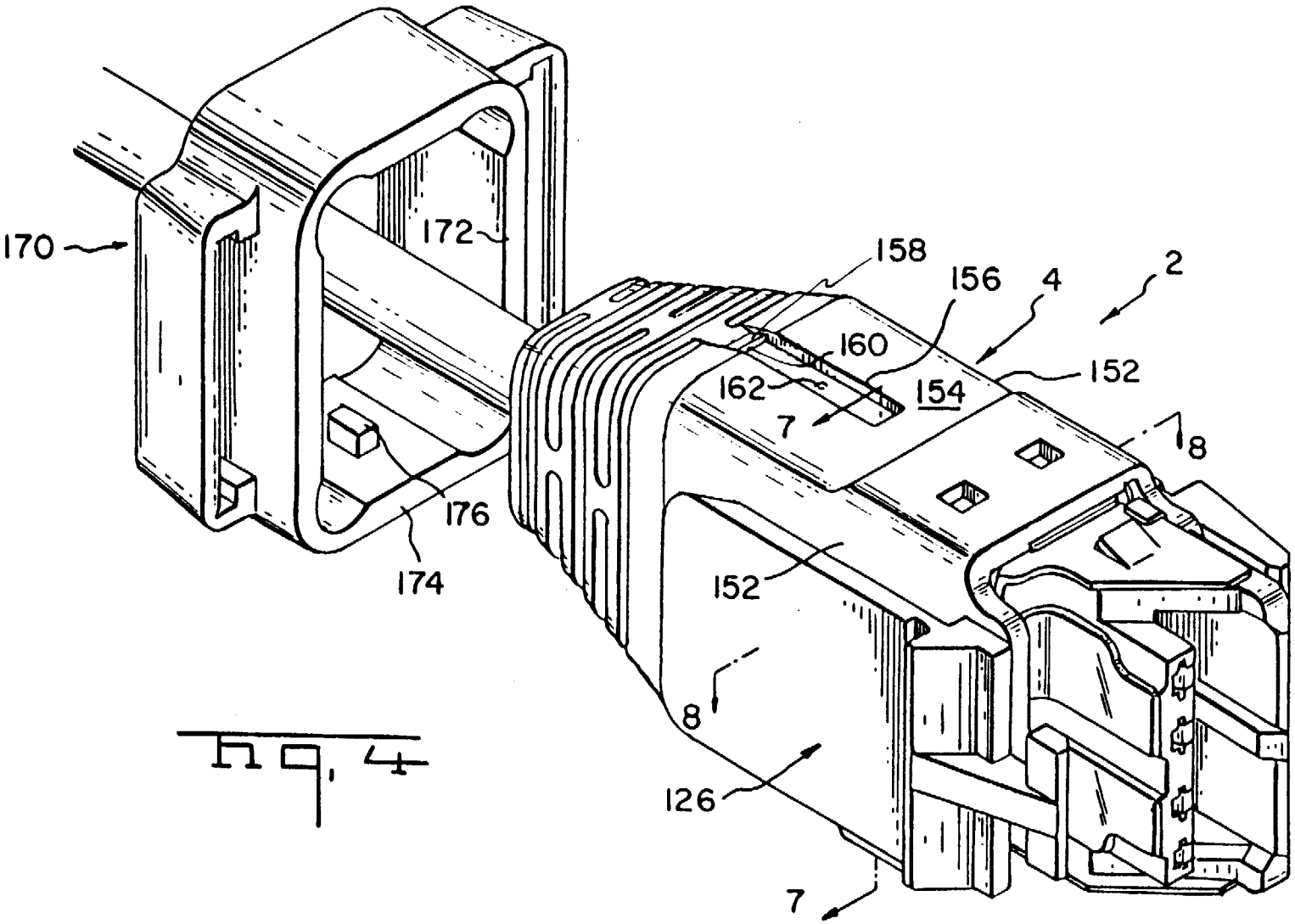
FIG. 4 is an isometric view of the assembled data connector, showing the slidable retention member exploded from the rear of the connector.

With reference again to FIG. 9, the premolded boot housing 4 further comprises a forward passageway 134 comprised of upper and lower surfaces 136 and side walls 138, where each of the side walls 138 includes an aperture 140 therethrough. The upper and lower surfaces 136 and side walls 138 terminate in a rear edge 142, which then communicates with a cavity 144, and thereafter a cable receiving bore 146. With reference now to FIG. 4, the premolded boot housing 4 comprises side walls 152 and end walls 154 (only one of which is shown in FIG. 4). The end walls 154 include a longitudinal slot 156 therein having an integral latch 158 having a forwardly facing latch surface 160. The longitudinal slot 156 further comprises a detent 162 integrally molded within the slot 156, and spaced forwardly of the latch 158.

Figure 5:
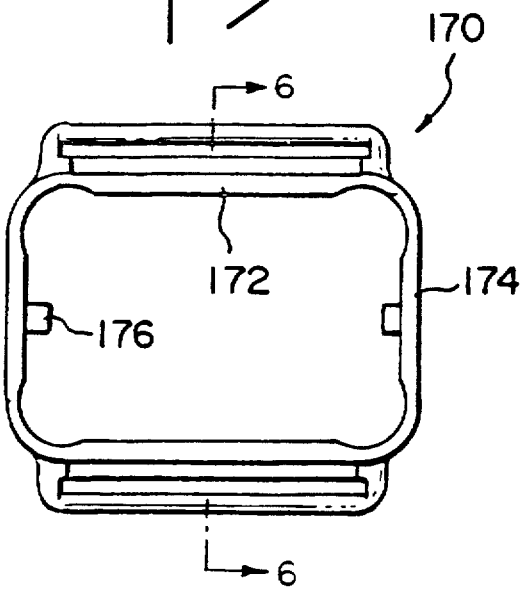
FIG. 5 is a front plan view of the sliding retention mechanism.
Figure 6:
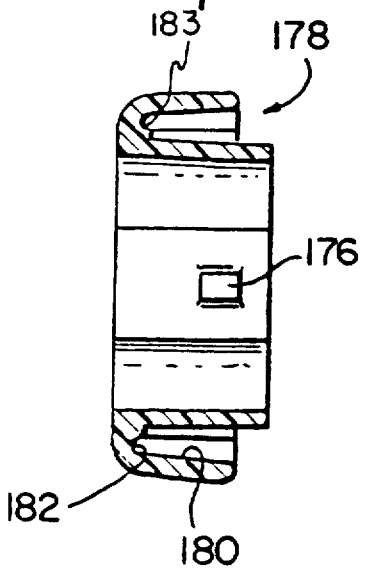
FIG. 6 is a cross-sectional view through lines 6—6 of FIG. 6.

With reference now to FIGS. 5 and 6, the connector assembly further comprises a slidable retention member or locking ring 170, having side walls 172 and end walls 174 where the side walls 172 are slidably engageable against the side walls 152 of the premolded boot housing 4 and the end walls 174 are slidably engageable against the end walls 154. As shown in FIG. 5, the end walls 174 include locking lugs 176 on inner surfaces thereof which are receivable in the slots 156 and guide the retention member along a longitudinal path. It should be understood that the latch 158 is of the type having a ramped surface increasing in height from the rear towards the front, such that when the lugs 176 pass the latches 158, the lug 176 is in latched engagement against the forwardly facing latch surface 160.

The latching member 170 further comprises channels 178 defining a locking enclosure which encompasses the free ends of the latch members. Each channel 178 has a ramped surface 180 converging inwardly from front to rear and terminating in a narrow slot 182. The slots 182 define support steps 183 extending across the locking member 170, and are adapted for receipt beneath the free ends of the latching members. Thus, in the locked position of FIG. 9, the free ends of the latch members are trapped between the surfaces 180 and the stepped portion, thereby preventing the pivotal movement of the latch members about the hinges 128.

The connector is assembled by sliding the terminals 13 into respective channels 12, and by inserting shorting bars 60 in respective grooves 23, as shown in FIG. 2. The shorting bars contact the commoning foot 38 on alternate terminals to common alternate terminals when the data connector is unmated. The multiconductor cable 180 (FIG. 1) is then slid through the opening 146 of the boot, and the boot housing 4 is slid back upon the cable 180. The shielded cable is then stripped to access the shielding braid 184 and the individual conductors 186 of the multiconductor cable. The individual conductors are placed in slots 54 of the stuffer cap 6 and the stuffer cap 6 is inserted into the housing with the ribs 52 aligned with slots 15 within the housing. The stuffer cap inserts the wires into individual terminals 13 with a conductor terminated within the barrel portion 32 of the terminal 13.

The shield members 7 and 8 are then assembled around the insulative housing 5 such that the slots 84 of the shield member 7 overlap the outside ribs 20, and the side tabs 104 of the shield member 8 are locked in place within the stamped windows 86 of the shield member 7.

Figure 7:
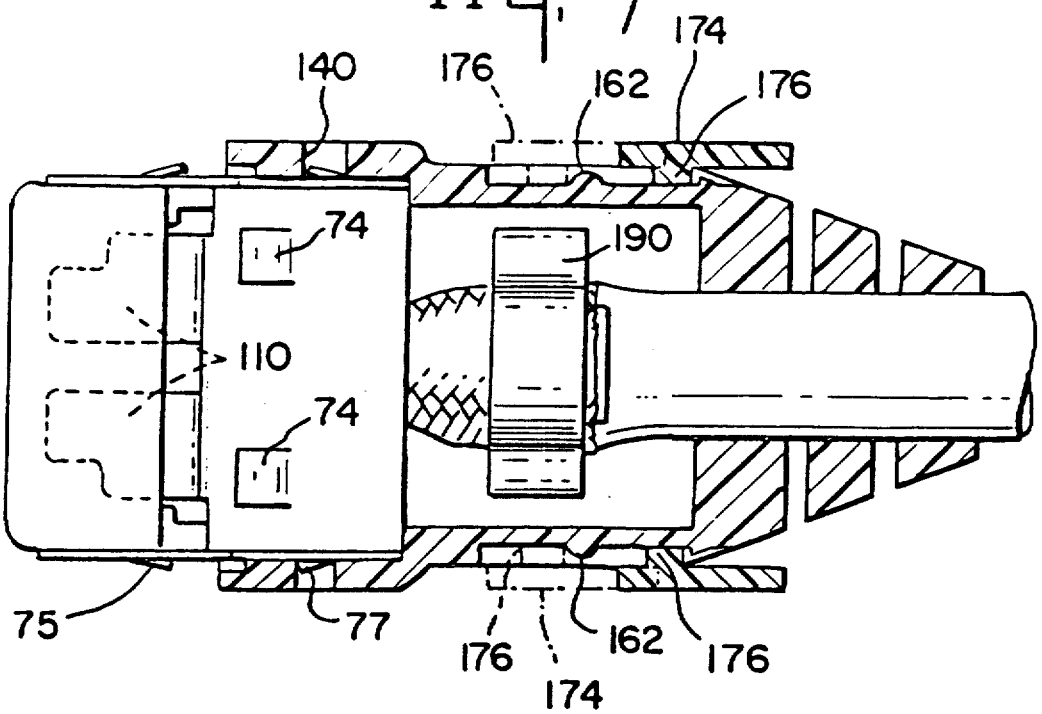
FIG. 7 is a cross-sectional view through lines 7—7 of FIG. 4.

This places the shielding extensions 76 and 116 in an overlapping relation over the dressed braid 184. A collapsible ferrule 190 (FIG. 1) can be crimped in place which electrically interconnects the shield members 7 and 8 to the shielding braid 184 and mechanically retains the shielded subassembly 3 to the multiconductor shielded cable 180. The previously inserted premolded boot housing 4 may now be slid forward until the windows 140 in the housing 4 are latched in place with the tabs 77, as shown in FIG. 7.

Figure 8:
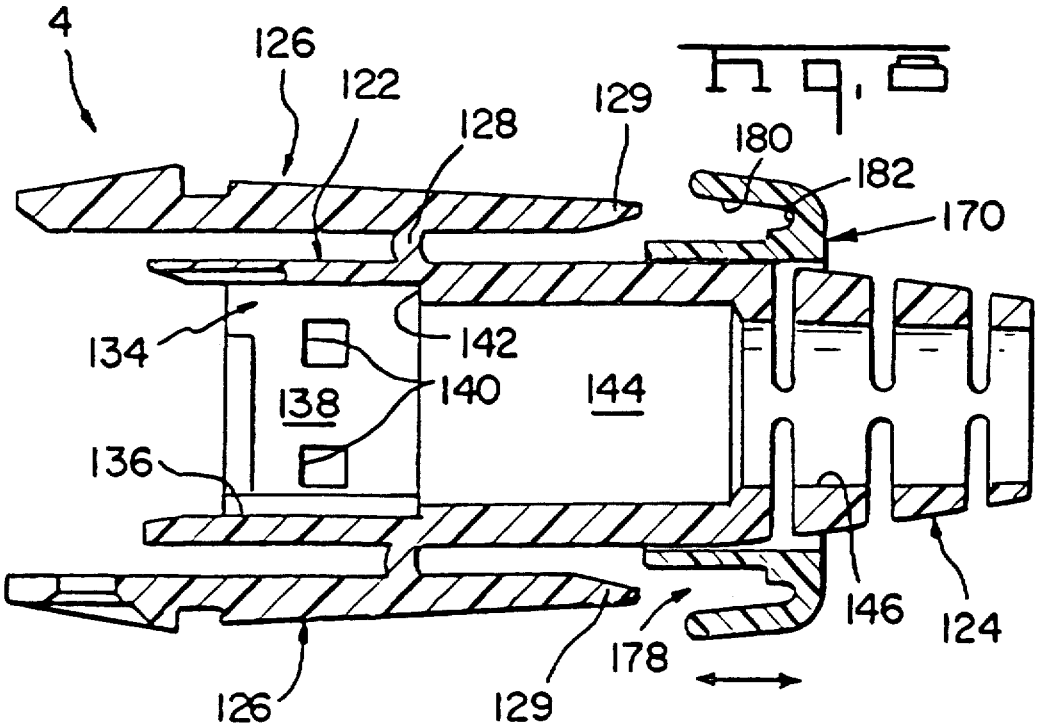
FIG. 8 is a cross-sectional view through lines 8—8 of FIG. 4 showing the sliding retention member in its rearwardmost position.

The slidable retention member 170 can be assembled to the boot housing, either prior to or subsequent to the assembly of the shielded subassembly 3. As shown in FIG. 7, the slidable retention member 170 is slidable between positions where the detent member 176 abuts the forwardly facing latch 158, as shown in FIGS. 4 and 7, to a position beyond the detent member 162 as shown in FIG. 7. The movement of the slidable retention member 170 between the positions shown in FIG. 7 corresponds to the movement of the retention member 170 between the positions shown in FIGS. 8 and 9. When the slidable retention member 170 is in the position shown in FIG. 8, the upper and lower latch members 126 are free to pivot about their integral hinge member 128 for latching and unlatching of the mateable electrical connectors. However, when the slidable retention member 170 is moved forwardly to the position shown in FIGS. 7 (in phantom) and 9, the ends of the latch members 126 are positioned in the transverse grooves 182 of the retention member 170. The ramp surface 180 also assists the end 129 of the latch member 126 for alignment with the transverse groove 182.

When the slidable retention member 170 is in the fully forward position of FIG. 9, the member 170 is retained in place by the engagement of the lugs 176 with the associated detents 162. Thus, when the slidable retention member 170 is in the position shown in FIG. 9, the two latch members 126 are prevented from pivotal movement about the integral web 128 thereby maintaining two interconnected mating connectors in a latched configuration.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. An electrical connector comprising:

an insulative housing having a mating face and a wire connecting face;

latching members integrally connected to opposite side surfaces of said housing, said latching members being integrally connected via molded webs of material medially positioned between ends of said latching members, one end of each said latching member having a latching mechanism thereon for mating with a complementary electrical connector, while opposite free ends of said latching members are free to move upwardly and downwardly during pivoting of said latching members;

a locking ring peripherally surrounding said insulative housing and movable longitudinally relative thereto between a locked and unlocked position, said locking ring having integral elongate channels adapted to encompass said free ends of said latching members when said locking ring is in said locked position, thereby preventing the pivotal movement of said latching members, and said locking ring being movable to an unlocked position where said channels are spaced from said free ends in a direction opposite said latching mechanism, and said free ends of said latching members are free to rotate about said webs.

2. The electrical connector of claim 1, wherein said channels progressively narrow from front to rear.

3. The electrical connector of claim 2, wherein said channels on said locking ring are formed by upper and lower surfaces, where said upper surfaces converge inwardly from front to rear.

4. The electrical connector of claim 3, wherein said channels narrow to a slot adapted to engage said free ends of said latching members.

5. The electrical connector of claim 1, wherein said housing includes slots formed in side surfaces of the housing and said locking ring includes guide tabs adapted to ride in said slots.

6. The electrical connector of claim 5, wherein said guide slots have detents therein cooperable with the guide tabs to define said locked and unlocked positions.

7. An electrical connector comprising:

an insulative housing having a mating face and a wire connecting face;

latching members integrally connected to opposite side surfaces of said housing, said latching members being integrally connected via molded webs of material medially positioned between ends of said latching members, one end of each said latching member having a latching mechanism thereon for mating with a complementary electrical connector, while opposite free ends of said latching members are free to move upwardly and downwardly during pivoting of said latching members;

a locking ring peripherally surrounding said insulative housing and movable longitudinally relative thereto between a locked and unlocked position, said locking ring having a stepped portion provided on both sides of said locking ring, said locking ring being longitudinally movable relative to said housing to simultaneously position said stepped portions beneath said free ends of said latching members, thereby preventing inward movement of said free ends.

8. The electrical connector of claim 7, wherein said locking ring further comprises an upper surface above each said stepped portion movable with said locking ring to overlap said free ends of said latching members in said locked position thereby preventing outward movement of said free ends.

9. The electrical connector of claim 8, wherein said upper surfaces and said stepped portions cooperatively define an open ended channel facing said free ends of said latching arms.

10. An electrical connector comprising:

an insulative housing having a mating face and a wire connecting face;

latching members integrally connected to opposite side surfaces of said housing, said latching members being integrally connected via molded webs of material medially positioned between ends of said latching members, one end of each said latching member having a latching mechanism thereon for mating with a complementary electrical connector, while opposite free ends of said latching members are free to move upwardly and downwardly during pivoting of said latching members;

locking means supported by said insulative housing and movable longitudinally relative thereto between a locked and unlocked position, said locking means having first and second elongate channels adapted to encompass said free ends of said latching members when said locking means is in said locked position, thereby preventing the pivotal movement of said latching members, and said locking means being movable to an unlocked position where said channels are spaced from said free ends in a direction opposite said latching mechanism, and said free ends of said latching members are free to rotate about said webs, wherein the locking means is profiled as a unitary locking ring profiled to extend peripherally surround said housing, said locking ring being movable longitudinally between a first position encompassing said free ends of said latching members to a second position spaced from said free ends of said latching members.

11. The electrical connector of claim 10, wherein said housing includes slots formed in side surfaces of the housing and said locking ring includes guide tabs adapted to ride in said slots.

12. The electrical connector of claim 11, wherein said guide slots have detents therein cooperable with the guide tabs to define said locked and unlocked positions.

* * * * *